US007252527B2

(12) United States Patent
Yang et al.

(10) Patent No.: US 7,252,527 B2
(45) Date of Patent: Aug. 7, 2007

(54) SURFACE CONTACT CARD HOLDER

(75) Inventors: Qing Yang, Shenzhen (CN); Chia-Hua Chen, Tu-Cheng (TW)

(73) Assignees: ShenZhen FuTaiHong Precision Industry Co., Ltd., Shenzhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/414,039

(22) Filed: Apr. 28, 2006

(65) Prior Publication Data

US 2006/0194466 A1 Aug. 31, 2006

(30) Foreign Application Priority Data

Jul. 8, 2005 (CN) ..... 2005 1 0035931

(51) Int. Cl.
*H01R 13/62* (2006.01)

(52) U.S. Cl. ..... 439/325; 439/327

(58) Field of Classification Search ..... 439/325, 439/327, 328

See application file for complete search history.

(56) References Cited

U.S. PATENT DOCUMENTS 6,343,945 B1 * 2/2002 Liikanen ..... 439/160
6,461,193 B1 * 10/2002 Matthies ..... 439/509
6,896,548 B2 * 5/2005 Scuteri et al. ..... 439/541.5

* cited by examiner

*Primary Examiner*—Tho D. Ta
*Assistant Examiner*—Vanessa Girardi
(74) *Attorney, Agent, or Firm*—Jeffrey T. Knapp

(57) ABSTRACT

A surface contact card holder (100) includes a body (10), a receiving mechanism (14), a guiding mechanism (20), and a latching member (25). The receiving mechanism is provided on the body for receiving a surface contact card (30) therein. The receiving mechanism has an aperture (142) defined in one end thereof for insertion and withdraw of the surface contact card. The guiding mechanism is provided on the body and adjacent to the aperture. The latching member is slidably mounted with the guiding mechanism for opening and closing the aperture of the receiving mechanism.

19 Claims, 5 Drawing Sheets

SURFACE CONTACT CARD HOLDER

BACKGROUND OF THE INVENTION

1. Field of the Invention

The present invention generally relates to mechanisms for holding card members in an electronic device and, particularly, to a surface contact card holder for holding a surface contact card in a portable electronic device.

2. Discussion of the Related Art

With the development of wireless communication and information processing technologies, portable electronic devices such as mobile phones are now in widespread use. These electronic devices enable consumers to enjoy high-tech services anytime and anywhere. Surface contact cards having special circuits are widely used in portable electronic devices to enhance or specialize the functions of the portable electronic devices. For example, a subscriber identity module (SIM) card can be placed in a mobile phone to dedicate the mobile phone' functions to the SIM card owner. By changing SIM cards, a single mobile phone can be used by many different SIM card owners as a personal phone.

Referring now to FIG. 5, a conventional mechanism for holding a SIM card therein includes a base 42 made of insulating material and a holding structure 44. The base 42 defines a receiving groove 421 and a SIM connector 40 including a plurality of contacts is set in the middle of the receiving groove 421. The shape and size of the receiving groove 421 are the same as those of the SIM card. The holding structure 44 is located adjacent to one end of the receiving groove 421 and can be moved back and forth along the direction as indicated by the arrow shown in FIG. 5.

In use, firstly, the holding structure 44 is moved away from the receiving groove 421 and the SIM card is inserted into the receiving groove 421. Then, the holding structure 44 is moved adjacent to the receiving groove 421 so as to latch the SIM card in the receiving groove 421. In the same way, the SIM card can be released by moving the holding structure 44 away from the receiving groove 421.

In the above conventional mechanism for holding a SIM card, the holding structure 44 can be easily moved, if a mobile phone employing such a mechanism for holding a SIM card drops to ground, and shock can easily force the holding structure 44 to move off the receiving groove 421. As a result, the SIM card will not connect well with the SIM contactor 30 or even be released from the receiving groove 421. Obviously, such a conventional mechanism can not hold the SIM card steadily in the receiving groove 421.

Therefore, there is a need for a new surface contact card holder which can hold a surface contact card steadily in a portable electronic device.

SUMMARY

In one embodiment, a surface contact card holder includes a body, a receiving mechanism, a guiding mechanism, and a latching member. The receiving mechanism is provided on the body for receiving a surface contact card therein. The receiving mechanism has an aperture defined in one end thereof for insertion and withdrawal of the surface contact card. The guiding mechanism is provided on the body adjacent to the aperture. The latching member is slidably mounted with the guiding mechanism for opening or closing the aperture of the receiving mechanism.

Other advantages and novel features of the present embodiment will become more apparent from the following detailed description thereof when taken in conjunction with the accompanying drawings.

BRIEF DESCRIPTION OF THE DRAWINGS

Many aspects of the surface contact card holder can be better understood with reference to the following drawings. The components in the drawings are not necessarily drawn to scale, the emphasis instead being placed upon clearly illustrating the principles of the present surface contact card holder. Moreover, in the drawings, like reference numerals designate corresponding parts throughout the several views.

DETAILED DESCRIPTION OF THE EMBODIMENTS

Figure 1:
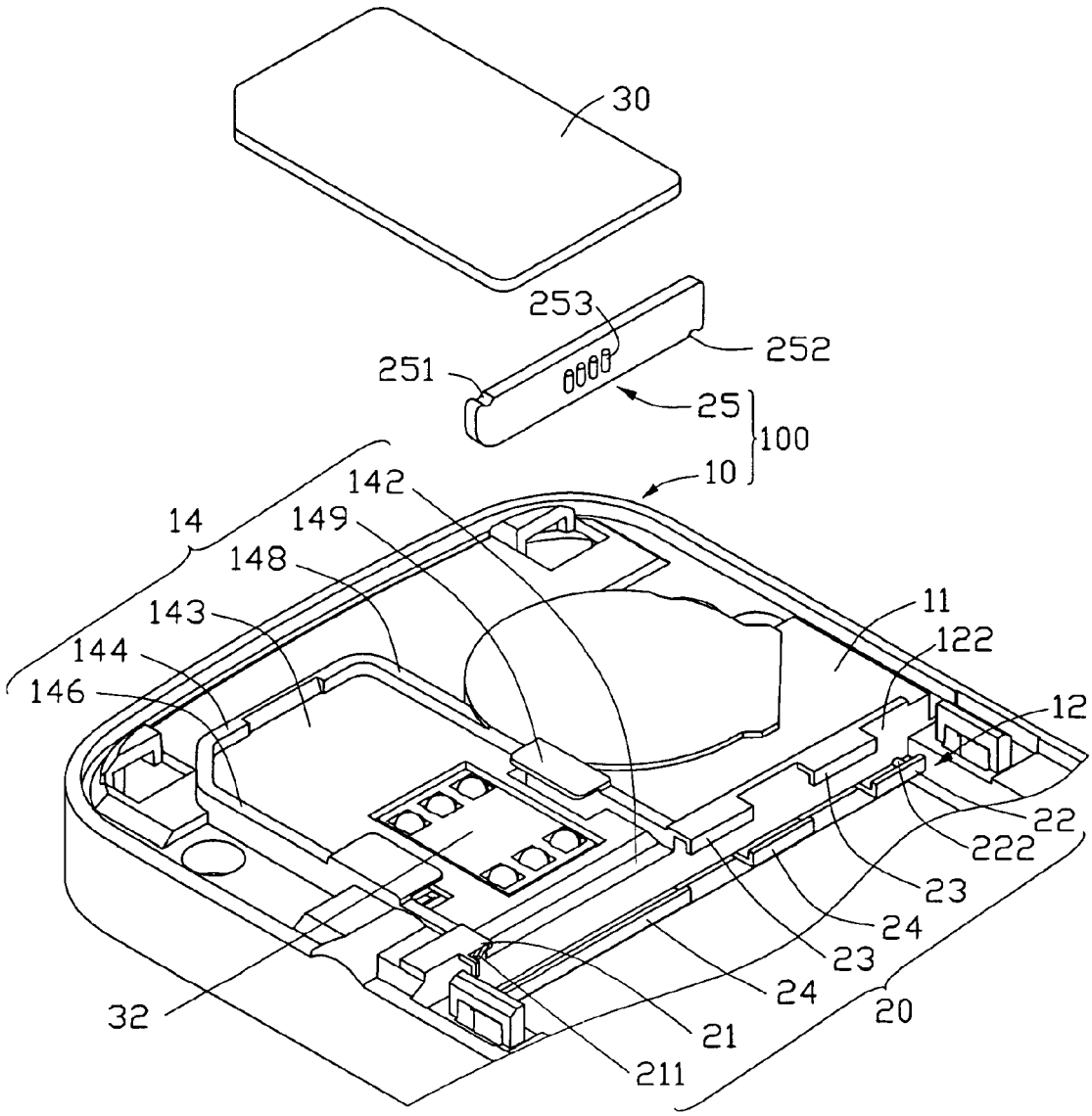
FIG. 1 is an exploded, isometric, cut away view of a surface contact card holder with a surface contact card in accordance with a preferred embodiment.

The present surface contact card holder can be used for holding surface contact cards such as SIM cards, compact flash cards (CFs), multimedia cards (MMCs), and so on. In a preferred embodiment of the present invention, FIG. 1 shows a surface contact card holder 100 for holding a SIM card 30 therein. The surface contact card holder 100 includes a body 10 provided with a receiving mechanism 14 and a guiding mechanism 20, and a latching board 25. The body 10 is a substantially rectangular board in shape and has a body surface II at one side thereof The body 10 defines a cavity 12 in one end thereof, thereby forming an inner side surface 122. The cavity 12 is substantially rectangular in shape. The inner side surface 122 is perpendicular to the body surface 11.

The receiving mechanism 14 is provided at the other opposite end of the body 10. The receiving mechanism 14 is configured for receiving the SIM card 30 therein. The receiving mechanism 14 includes a left sidewall 146, a right sidewall 148, a connecting sidewall 144, and a pair of holding pieces 149. The left sidewall 146 and the right sidewall 148 both extend from the body surface 11, and are parallel to each other. The connecting sidewall 144 extends from the body surface 11, and connects one end of the left sidewall 146 and one end of the right sidewall 148. The other opposite end of the left sidewall 146 and the other opposite end of the right sidewall 148 together define an aperture 142 therebetween. The aperture 142 is adjacent to the inner side surface 122. The holding pieces 149 extend respectively and perpendicularly from the left sidewall 146 and the right sidewall 148, and face towards each other. Each holding piece 149 is a substantially rectangular board in shape. The left sidewall 146, the right sidewall 148, the connecting sidewall 144, the holding pieces 149, and the body surface 11 cooperate to define a receiving groove 143. The receiving groove 143 is a receiving space configured for receiving the SIM card 30 therein. The SIM card 30 can enter into or withdraw from the receiving groove 143 via the aperture 142. A SIM connector 32 having a plurality of contacts is provided in the body 10, and is exposed out of the body surface 11 and in the receiving groove 143. When the SIM card 30 is inserted into the receiving groove 143, the SIM card 30 is electronically connected with the SIM connector 32 for transferring the information in the SIM card 30 to a processor (not shown) in the body 10.

The guiding mechanism 20 is provided on the inner side surface 122 and is made of an elastic material. The guiding mechanism 20 is configured for movably receiving the latching board 25. The guiding mechanism 20 includes a first positioning portion 21, a second positioning portion 22, a pair of top guiding pieces 23, and a pair of bottom guiding pieces 24.

The first positioning portion 21 extends perpendicularly from a top side of one end of the inner side surface 122, into the cavity 12 and adjacent to the left sidewall 146 of the receiving mechanism 14. A first positioning projection 211 extends downwards from one surface of the first positioning portion 21 into the cavity 12. The first positioning projection 211 is substantially half-columnar in shape. An axis of the first positioning projection 211 is perpendicular to the inner side surface 122.

The second positioning portion 22 extends perpendicularly from a bottom side of the other opposite end of the inner side surface 122, into the cavity 12. A second positioning projection 222 extends upwards from one surface of the second positioning portion 22 and into the cavity 12. The second positioning projection 222 is similar to the first positioning projection 211 and is a substantially half-column in shape. An axis of the second positioning projection 222 is perpendicular to the inner side surface 122. A protrusion extends perpendicularly from a distal end of the second positioning portion 22 and towards the top side of the inner side surface 122.

The top guiding pieces 23 extend separately from the top side of the inner side surface 122, into the cavity 12 and away from the aperture 142 of the receiving mechanism 14. A protrusion extends perpendicularly from each distal end of the top guiding pieces 23 towards the bottom side of the inner side surface 122. The bottom guiding pieces 24 extend separately from the bottom side of the inner side surface 122, into the cavity 12 and adjacent the aperture 142 of the receiving mechanism 14. A protrusion extends perpendicularly from each distal end of the bottom guiding pieces 24 and toward the top side of the inner side surface 122. The first positioning portion 21, the second positioning portion 22, the top guiding pieces 23, the bottom guiding pieces 24, and the inner side surface 122 cooperate to define a channel for movably receiving the latching board 25.

The latching board 25 is a substantially rectangular board in shape. The size of the latching board 25 is similar to that of the channel of the guiding mechanism 20 so that the latching board 25 is slidable in the channel. A first positioning notch 251 is defined at a top side of one end of the latching board 25. The first positioning notch 251 is a substantially half-circle in shape for receiving the first positioning projection 211 of the first positioning portion 21 therein. A second positioning notch 252 is defined at a bottom side of the other opposite end of the latching board 25. The second positioning notch 252 is a substantially half-circle in shape for receiving the second positioning projection 222 of the second positioning portion 22 therein. A pushing grip 253 is formed on an outer surface of the latching board 25 for pushing operation of the latching board 25.

When assembling the latching board 25 with the guiding mechanism 20, the latching board 25 is forced into the channel of guiding mechanism 20 against the protrusions of the first positioning portion 21, the second positioning portion 22, and the bottom guiding pieces 24. When the first positioning projection 211 is engaged in the first positioning notch 251, the latching board 25 is in a first position and closes the aperture 142 of the receiving mechanism 14. When the second positioning projection 222 is engaged in the second positioning notch 252, the latching board 25 is in a second position and is away from and thus opens the aperture 142.

Figure 2:
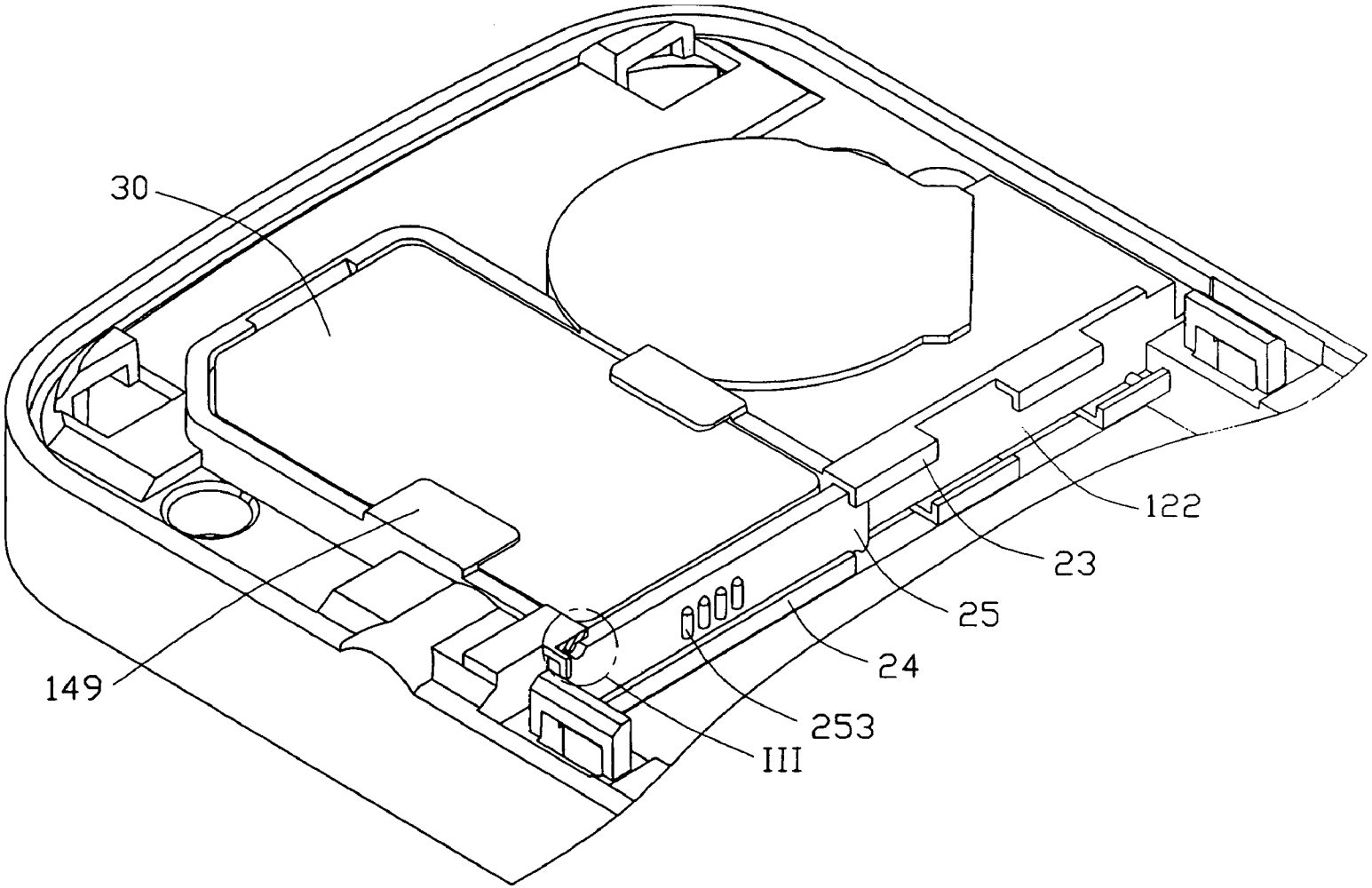
FIG. 2 is an assembled, cut away view of the surface contact card holder and the surface contact card, showing the surface contact card holder in a first position.
Figure 3:
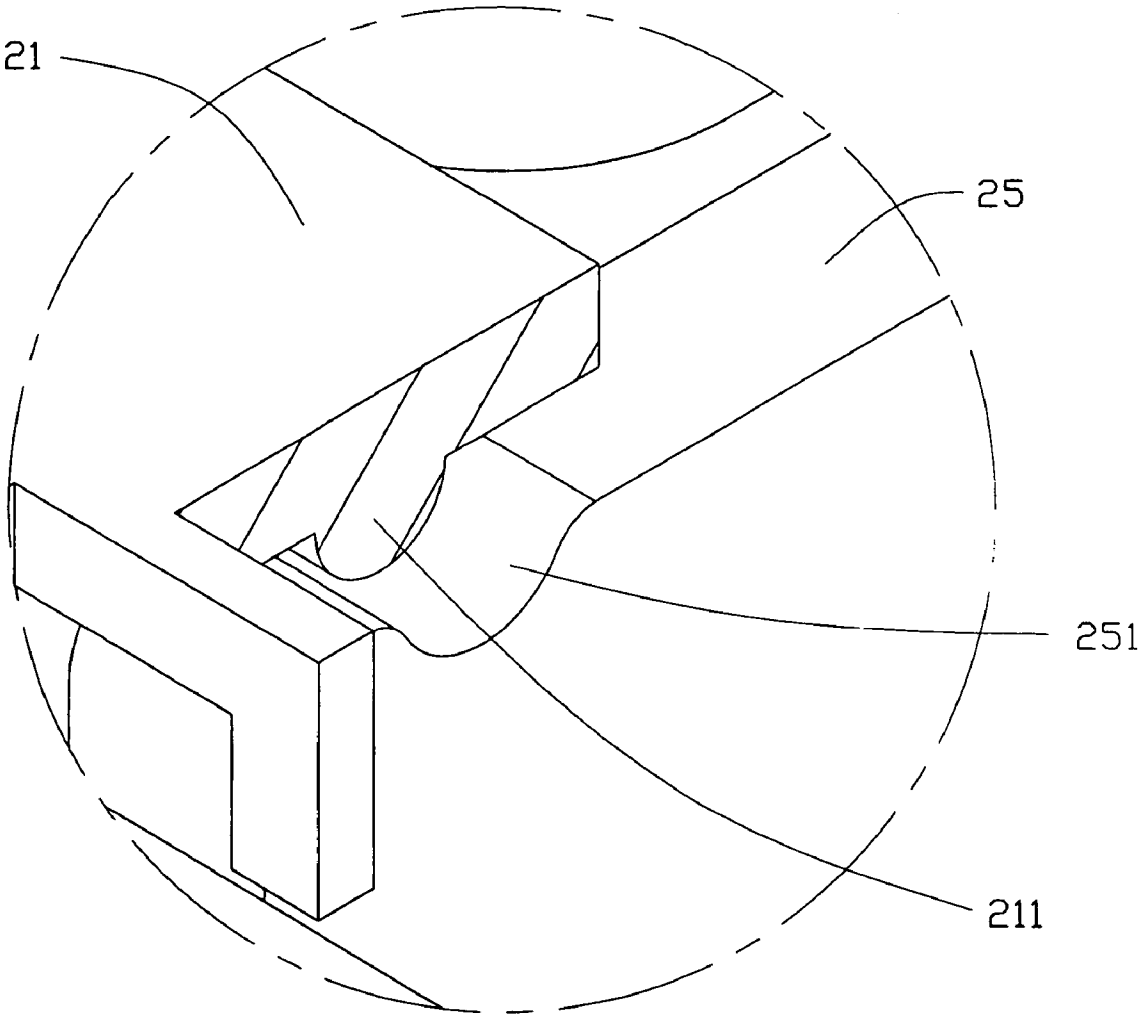
FIG. 3 is enlarged cross-sectional view of a first positioning portion and a latching board of the surface contact card holder taken along III line of FIG. 2.
Figure 4:
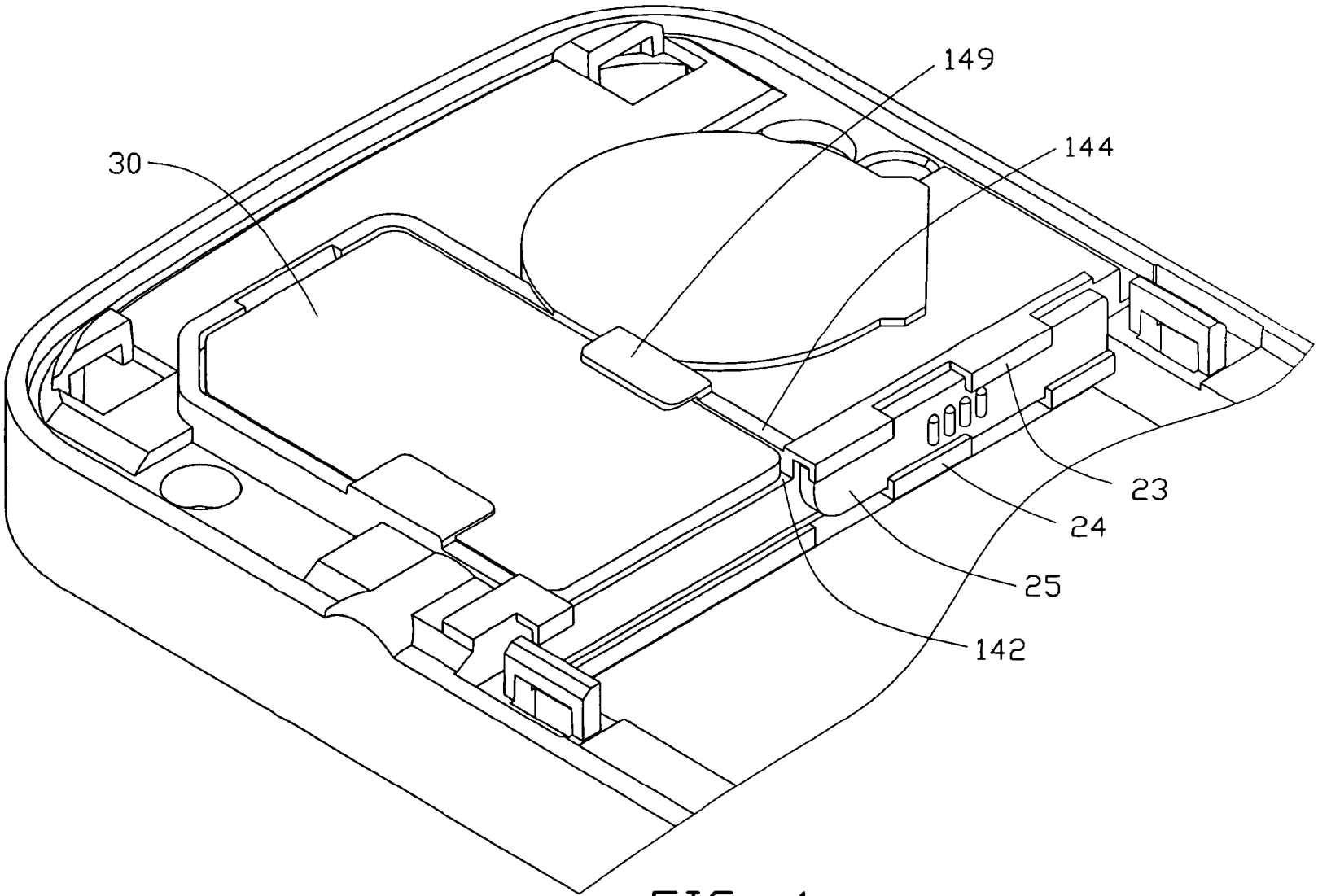
FIG. 4 is similar to FIG. 2 but showing the surface contact card holder in a second position.
Figure 5:
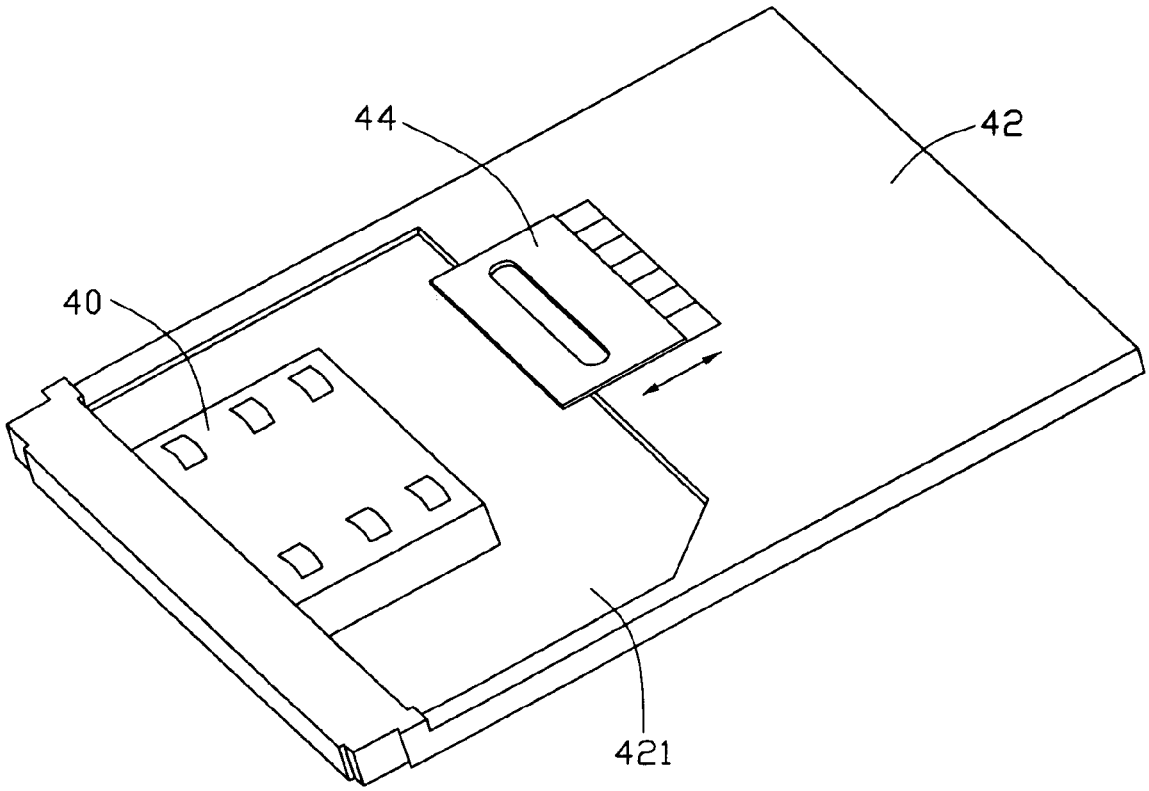
FIG. 5 (RELATED ART)
FIG. 5 is an exploded, isometric view of a conventional SIM card holder.

Referring to FIG. 4, in use, to mount the SIM card 30 with the body 10, the latching board is firstly in the second position, and the second positioning projection 222 is engaged in the second positioning notch 252. The SIM card 30 is pushed into the receiving groove 143 through the aperture 142. Now the receiving mechanism 14 holds the SIM card 30 in a first direction by the cooperation of the left sidewall 146 and the right sidewall 148, and in a second direction by the cooperation of the holding pieces 149 and body 10. The first direction is perpendicular to the second direction. The latching board 25 is pushed toward the first positioning portion 21 by pushing the pushing grip 253, until the latching board 25 is in the first position. In this process, the second positioning projection 222 is moved out from engagement with the second positioning notch 252, and the first positioning projection 211 is moved into the first positioning notch 251, as best shown in FIG. 3. The latching board 25 closes the aperture 142, and the SIM card 30 is held in a third direction by the cooperation of the latching board 25 and the connecting sidewall 144. The third direction is perpendicular to the first and second directions. Thus the SIM card 30 is mounted into the body 10, as shown in FIG. 2.

To remove the SIM card 30, the latching board 25 is pushed toward the second positioning portion 22 by pushing the pushing grip 253. In this process, the first positioning projection 211 is moved out from engagement with the first positioning notch 251, and the second positioning projection 222 is moved into the second positioning notch 252. The aperture 142 is opened, and the SIM card 30 can be removed.

In an alternate embodiment, the number of the holding pieces 149 can be one or more. The shape of holding piece 149 is not limit to a substantially rectangular board in shape. The first and second positioning portions 21, 22 may act only as guiding pieces similar to guiding pieces 23, 24. The positioning projections may be formed on other guiding pieces. The positioning notches are arranged corresponding to the positioning projections such that the latching board 25 opens or closes the aperture 142 of the receiving mechanism 14.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

We claim:

1. A surface contact card holder comprising:

a body;

a receiving mechanism provided on the body for receiving a surface contact card therein and having an aperture defined in one end thereof for insertion and withdraw of the surface contact card;

a guiding mechanism provided on the body adjacent to the aperture, the guiding mechanism including a plurality of guiding pieces, the guiding pieces extending from the body and cooperatively forming a channel therein; and a latching member slidably mounted in the channel of the guiding mechanism for closing or opening the aperture of the receiving mechanism.

2. The surface contact card holder as claimed in claim 1. wherein a first positioning projection extends from one of the guiding pieces, and the latching member defines a first positioning notch at one side thereof for engaging with the first positioning projection in order to position the latching member.

3. The surface contact card holder as claimed in claim 1, wherein the latching member is a rectangular board.

4. The surface contact card holder as claimed in claim 1, wherein the receiving mechanism comprises a left sidewall and a right sidewall, and the left sidewall and the right sidewall hold the surface contact card in a first direction.

5. The surface contact card holder as claimed in claim 4, wherein a holding piece extends perpendicularly from one of the left sidewall and the right sidewall, and the holding piece and the body hold the surface contact card in a second direction perpendicular to the first direction.

6. The surface contact card holder as claimed in claim 5, wherein the receiving mechanism further comprises a connecting sidewall configured for connecting one end of the left sidewall and one end of the right sidewall, the connecting sidewall and the latching member hold the surface contact card in a third direction, and the third direction is perpendicular to the first and second directions.

7. The surface contact card holder as claimed in claim 6, wherein the sidewall connects one end of the left sidewall and one end of the right sidewall.

8. The surface contact card holder as claimed in claim 6, wherein the latching member is linearly slidable along the first direction.

9. A holder for holding a surface contact card in a portable electronic device having a device body, the holder comprising:

a receiving mechanism provided on the device body, the receiving mechanism being configured for receiving the surface contact card therein and holding the surface contact card in a first direction and a second direction;

a guiding mechanism provided on the body; and a latching member mounted with the guiding mechanism and being linearly slidable along one of the first and second directions, the latching member thereby being able to be selectably slid so as to cooperate with the receiving mechanism to hold the surface contact card in a third direction.

10. The holder as claimed in claim 9, wherein the first direction is perpendicular to the second direction.

11. The holder as claimed in claim 10, wherein the third direction is respectively perpendicular to the first and second direction.

12. The holder as claimed in claim 9, wherein the guiding mechanism comprises, a plurality of guiding pieces extending from the body, and the guiding pieces cooperatively form a channel therein for slidably receiving the latching member.

13. The holder as claimed in claim 12, wherein a first positioning projection extends from one of the guiding pieces, and the latching member defines a first positioning notch at one side thereof for engaging with the first positioning projection in order to position the latching member.

14. A portable electronic device comprising:

a body;

a receiving mechanism provided on the body, the receiving mechanism defining a receiving groove configured for receiving a surface contact card therein and for holding the surface contact card in a first direction and a second direction, and having an aperture defined at one end of the receiving groove for insertion and withdrawal of the surface contact card;

a guiding mechanism provided on the body and adjacent to the aperture, the guiding mechanism defining a channel; and a latching member mounted in the channel of the guiding mechanism, the latching member being slidable along one of the first and second directions and thereby being configured for selectably closing or opening the aperture of the receiving mechanism.

15. The portable electronic device as claimed in claim 14, wherein the guiding mechanism comprises a plurality of guiding pieces extending from the body, and the guiding pieces cooperatively form the channel therebetween.

16. The portable electronic device as claimed in claim 15, wherein a first positioning projection extends from one of the guiding pieces, and the latching member defines a first positioning notch at one side thereof for engaging with the first positioning projection in order to position the latching member.

17. The portable electronic device as claimed in claim 14, wherein the first direction is perpendicular to the second direction.

18. The portable electronic device as claimed in claim 17, wherein the latching member cooperates with the body to hold the surface contact card in a third direction.

19. The portable electronic device as claimed in claim 18, wherein the third direction is respectively perpendicular to the first and second direction.

* * * * *